US005163185A

United States Patent [19]

Hodnett

[11] Patent Number: 5,163,185

[45] Date of Patent: Nov. 17, 1992

[54] HELMET WITH INTERCHANGEABLE LENSES

[76] Inventor: Jack L. Hodnett, 418 Hooper Rd., Deville, La. 71328

[21] Appl. No.: 718,965

[22] Filed: Jun. 21, 1991

[51] Int. Cl.[5] ..... A42B 1/08

[52] U.S. Cl. ..... 2/424; 2/422; 2/438

[58] Field of Search ..... 2/8, 9, 10, 205, 410, 2/422, 424, 427, 429, 431, 432, 434, 435, 438, 441

[56] References Cited

U.S. PATENT DOCUMENTS

| | | | |
|---|---|---|---|
| 1,969,710 | 8/1934 | Jones | 2/438 |
| 2,119,439 | 5/1938 | Parmelee | 2/8 |
| 2,592,805 | 4/1952 | Hutchinson | 2/8 |
| 2,886,819 | 5/1959 | Uphoff . | |
| 3,577,563 | 5/1971 | Raschke | 2/8 |
| 3,946,442 | 3/1976 | Wallander | 2/9 |
| 4,076,373 | 2/1978 | Moretti | 2/434 |
| 4,215,436 | 8/1980 | Ketterer | 2/424 |
| 4,428,081 | 1/1984 | Smith | 2/438 |
| 4,528,701 | 7/1985 | Smith | 2/438 |
| 4,542,538 | 9/1985 | Moretti et al. | 2/438 |
| 4,748,697 | 6/1988 | Hodnett | 2/438 |

FOREIGN PATENT DOCUMENTS

| | | | |
|---|---|---|---|
| 503752 | 6/1954 | Canada | 2/8 |
| 2511243 | 9/1976 | Fed. Rep. of Germany | 2/438 |
| 2819555 | 11/1979 | Fed. Rep. of Germany | 2/8 |

*Primary Examiner*—Werner H. Shcroeder
*Assistant Examiner*—Michael A. Neas
*Attorney, Agent, or Firm*—John M. Harrison

[57] ABSTRACT

A helmet which is characterized by a rounded top and a shaped cowl provided with two sets of spaced slots defined by three tracks spanning an open lens window for receiving a transparent lens slidably mounted in an outside set of parallel slots and an optional tinted lens mounted in an inside set of parallel slots, for closing the lens window. In a preferred embodiment the transparent lens is a tear-away lens connected at a perforated interface to the next one of several additional lenses wound in end-to-end relationship in a roll, which roll is located inside a canister attached to the cowl of the helmet. Each transparent lens on the roll is individually, selectively and sequentially extended through a feed opening in the canister and through the parallel outside lens slots to a track lip projecting from the opposite side of the cowl, when the preceding lens is so damaged or coated as to adversely affect visibility and is slidably removed from the lens tracks. When the damaged lens is slidably extended from the lens slots in the face mask cowl for removal, a second lens is automatically unrolled from the canister and slidably positioned over the lens window and the damaged lens is torn from the leading edge of the newly positioned lens at the perforated interface between the lenses.

24 Claims, 4 Drawing Sheets

FIG. 1
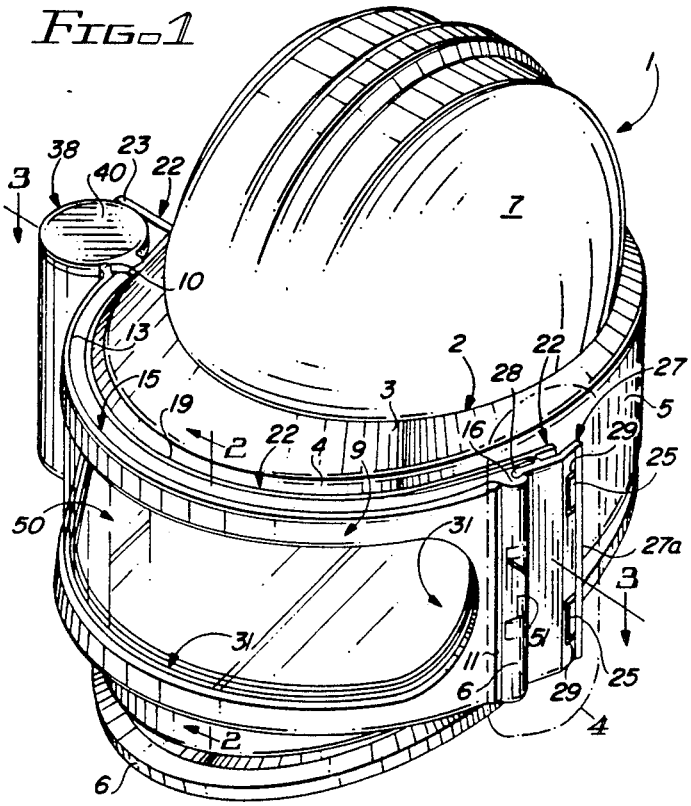
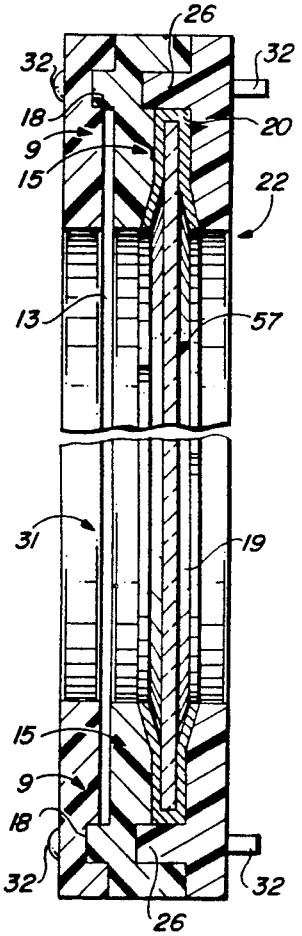
FIG. 2
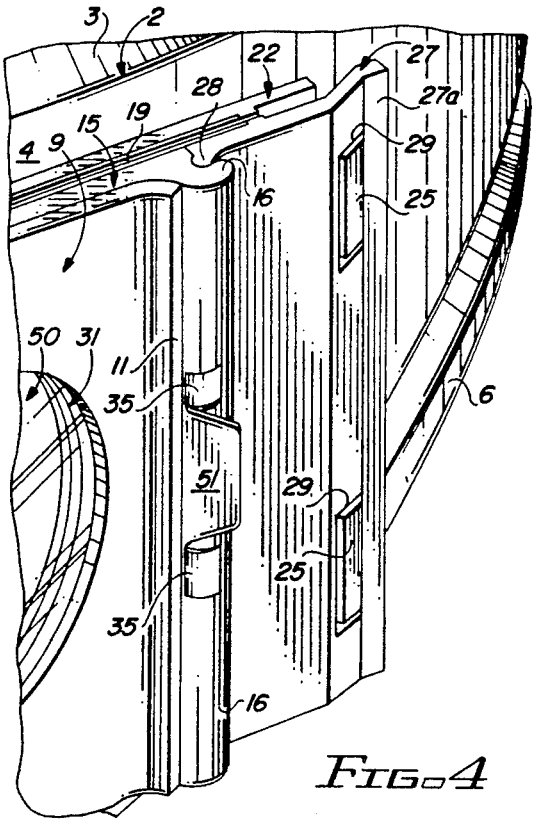
FIG. 4
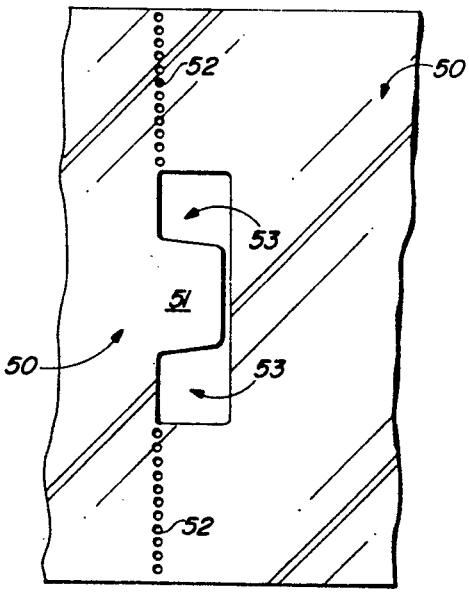
FIG. 5

HELMET WITH INTERCHANGEABLE LENSES

BACKGROUND OF THE INVENTION

1. Field of the Invention

This invention relates to masks, single lens goggles and helmets used for painting, sandblasting and other activities requiring that the head, face or eyes be covered and protected while working. More particularly, the invention relates to a protective mask, helmet or single lens goggles having interchangeable lenses, and specifically, to a helmet which is characterized by an open lens window bordered by a pair of parallel sets of top and bottom lens slots defined by three tracks in a flexible cowl. The parallel outside lens slots are designed to receive a flexible, transparent lens which is attached to one in a series of adjacent lenses in end-to-end, rolled and perforated relationship and loaded in a canister which is removably attached to the outside and inside tracks. Each lens can be slidably projected across the open lens window by inserting the leading edge thereof through a feed opening in the canister and sliding the lens through the upper and lower outside slots between the outside and middle tracks bordering the lens window. When so positioned, the lens can be used until it is either obscured by paint or scratched or until visibility through the lens is otherwise limited or obscured. The leading edge of the lens can then be grasped at the track lip of the track insert and the lens pulled completely from the lens window to a line of perforation, at which time the adjacent and connected lens is extended from the canister and located in functional position, replacing the first lens. The damaged first lens can then be torn from the adjacent new lens at the track lip along the perforations and discarded. In a preferred embodiment, a tinted lens may be inserted in a pair of parallel inside lens slots defined by the middle and inside tracks, which parallel inside lens slots are spaced from the parallel transparent lens slots.

One of the problems which exists in industries that deal with painting, sandblasting and other activities which require the use of protective face masks, goggles and helmets with lenses, is that of periodically damaging or obscuring the lenses, thereby requiring that the protective equipment be discarded. Face masks which are commonly used to protect the eyes are typically shaped from a soft rubber or plastic material and the lens is usually constructed of a soft, flexible plastic or similar material which is easily abraded, fogged or scratched to obscure the vision of the wearer. Alternatively, in such operations as painting, paint can quickly settle on the lens and obscure the vision of the wearer, thereby requiring that the mask or helmet be discarded. While the cost of these masks is not usually excessive, the cost of the entire mask or helmet is generally significantly higher than the cost of replacing the lens itself.

2. Description of the Prior Art

Various types of industrial masks, goggles and helmets are well known in the art for such industrial applications as painting, sandblasting and other operations requiring shielding of the eyes and/or protection of the face.

The most simple eyeshields commonly used in industry are one-piece, transparent goggles and eyeglasses which are provided with plastic frames and shatter-proof lenses for general application in an environment where eye hazards exist. Other eyeshields such as face masks and goggles which are commonly constructed of a soft rubber or plastic material with plastic lenses, are well known in the art and are used in such applications as painting, certain shop applications and other industrial applications requiring eye protection. More complex helmets and hoods fitted with lenses for viewing the work area are also known in the art for such applications as welding and sandblasting, where both the eyes and face must be protected. Helmets of this nature are typified by the Clemco Industries "Widespan" helmet, model WSH, which is characterized by an extra large window mounted in a helmet that carries a hood or cape for use in such operations as sandblasting. The "Widespan" helmet includes multiple, easily replaceable, peel-off acetate lenses which are attached over a fixed outer lens or window, in order to assure good visibility during the course of the job. As each acetate lens becomes dirty, pitted or is otherwise rendered unusable, it is peeled from the underlying lens to expose the clean lens. If the peel-off acetate lenses are not used, then the underlying helmet lens or window must be replaced if it is damaged. A similar helmet marketed by Clemco Industries is known as the "Apollo" helmet, which is constructed with a double shell to permit air circulation throughout the entire head area. The window viewing is slanted downwardly to allow clear vision to the lower part of the work area and to increase the overall field of vision. Multiple, peel-off acetate lenses allow convenient replacement of frosted, pitted or otherwise damaged outside lens. Pertinent patents relating to the helmet with interchangeable lenses of this invention are as follows: U.S. Pat. No. 2,119,439, dated May 31, 1938, to A. H. Parmeles; U.S. Pat. No. 2,592,805, dated Apr. 15, 1952, to H. H. Hutchinson; U.S. Pat. No. 2,886,819, dated May 19, 1959, to J. H. Uphoff; U.S. Pat. No. 4,428,081, dated Jan. 31, 1984, to Robert E. Smith; U.S. Pat. No. 4,542,538, dated Sep. 24, 1985, to A. L. Moretti; and my U.S. Pat. No. 4,748,697, dated Jun. 7, 1988.

One of the problems which exists with prior art face masks, goggles and helmet systems wherein the lens can be easily obscured by paint, frosting, pitting or other damage, is the requirement of replacing the lens in the helmet or discarding the goggles or face mask when such an event occurs. For example, in the case of the Clemco "Widespan" helmet and the "Apollo" helmet, at least one peel-off acetate lenses must be applied to the underlying base lens or window, in order to facilitate a means of periodically replacing the exposed and damaged lens. Accordingly, if the operator fails to remember to place the multiple peel-on acetate lenses over the underlying permanent lens, the permanent lens itself can be inadvertently exposed and damaged, thus necessitating replacement and perhaps causing costly down-time on the job. Furthermore, the peeling off of successive layers of acetate or other plastic-type lenses can be laborious and time-consuming and each of these lenses must be provided with an adhesive, in order to secure successive layers of the lenses to the underlying base lens and to each other. Another problem which may become apparent with regard to the use of thin, peel-off acetate lenses, is that of simultaneously pitting the underlying lens or lenses when the exposed lens is damaged by sandblasting or other industrial operations.

Accordingly, it is an object of this invention to provide a new and improved face mask, single lens goggles or helmet that is provided with interchangeable, transparent lenses which are carried in a canister attached to the face mask, goggles or helmet and are successively slidably replaced in the lens window of the face mask, goggles or helmet as the exposed, damaged lenses are individually removed.

Another object of this invention is to provide a new and improved helmet having a linear interchangeable lens capability, which helmet is provided with a canister fitted with multiple, flexible, rolled lenses attached in end-to-end, perforated relationship, which lenses are adapted for sequential feeding through a slot opening in the canister and through a pair of parallel slots spanning the lens window of the face mask, in order to successively and slidably remove damaged lenses and slide new lenses into position over the lens window in a single operation, as deemed necessary.

Yet another object of this invention is to provide a new and improved helmet formed of plastic or other desirable material and provided with a canister and a lens window bordered by two sets of parallel, spaced slots defined by three tracks, which canister contains multiple, flexible, rolled lenses mounted in perforated, end-to-end relationship, for slidably and sequentially extending through a slot opening in the canister and engaging an outside pair of slots defined by the outside and middle tracks and covering the lens window, such that each lens can be slidably replaced when damaged or obscured, by removing the damaged or obscured lens from the lens window, simultaneously slidably replacing that lens with an adjacent lens from the canister and tearing the old lens from the new one along the perforations.

Still another object of this invention is to provide a new and improved helmet with separate interchangeable transparent and tinted lenses, which helmet includes a rounded top and cowl constructed of plastic or other suitable material and provided with parallel sets of slots defined by three rigid tracks attached to the cowl and a canister removably mounted on one end of the tracks, which canister contains multiple, transparent plastic lenses that are rolled inside the canister and are attached in perforated, end-to-end relationship, for sequentially extending through a first, or outside set of parallel slots located between outside and middle tracks and across the lens window of the face mask. Damaged or obscured lenses are successively slidably removed from the lens window while simultaneously extending a second adjacent lens from the canister across the lens window in functional configuration and the removed lens is then torn from the new lens along the perforated interface. A second tinted lense may be inserted in the second, or inside set of parallel slots defined by the middle and inside tracks by opening a door hinged to the middle track outwardly of the cowl.

SUMMARY OF THE INVENTION

These and other objects of the invention are provided in a new and improved helmet having linearly interchangeable, transparent lenses and an optional tinted lense, which face mask is characterized by a shaped cowl fitted with three rigid tracks having an open lens window and defining two sets of top and bottom parallel slots for receiving the first one of a strip of several flexible, transparent lenses provided in rolled, perforated, end-to-end relationship in a canister removably attached to the track insert and a tinted lens, respectively. As each transparent lens is damaged or visually obscured and requires replacement, it is slidably displaced from the outside set of top and bottom slots and over the lens window, to pull the adjacent lens through a slot in the canister and into the first set of top and bottom slots and across the lens window. The first lens is then severed from the second lens at a perforation to provide a means for replacing lenses in the face mask or goggles. A tinted lens is inserted in the inside set of top and bottom slots after opening a door hinged to the inside track.

BRIEF DESCRIPTION OF THE DRAWING

The invention will be better understood by reference to the accompanying drawing, wherein:

FIG. 1 is a perspective view of a preferred embodiment of the helmet with interchangeable lenses of this invention;

FIG. 2 is a sectional view taken along line 2—2 of the helmet illustrated in FIG. 1;

FIG. 4 is an enlarged perspective view of a preferred door assembly for insertion and removal of a tinted lens in the helmet illustrated in FIG. 1;

FIG. 5 is a plan view of preferred method of attaching transparent lenses to define a lens roll used in connection with the helmet illustrated in FIG. 1;

DESCRIPTION OF THE PREFERRED EMBODIMENTS

Figure 3:
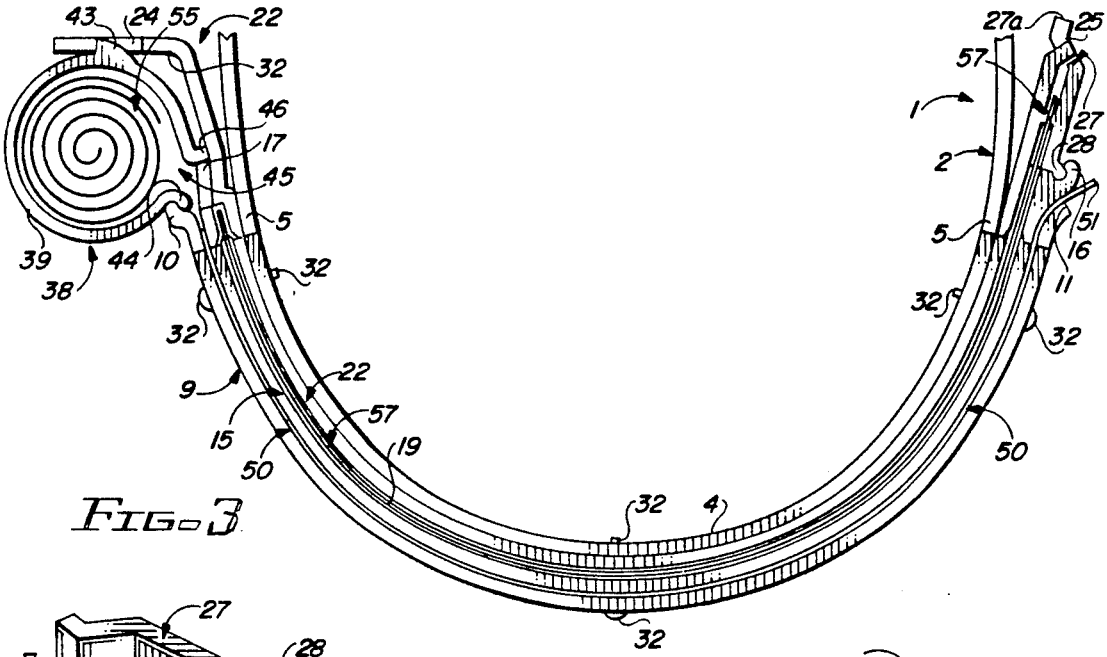
FIG. 3 is a sectional view taken along the line 3—3 of the helmet illustrated in FIG. 1.
Figure 6:
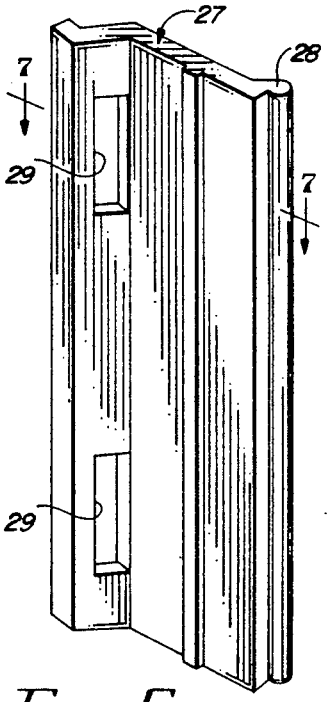
FIG. 6 is a perspective view of a door element of the door assembly illustrated in FIG. 4.
Figure 9:
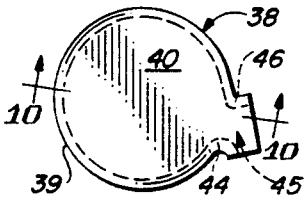
FIG. 9 is a top view of the canister illustrated in FIG. 8.
Figure 10:
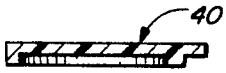
FIG. 10 is a sectional view taken along 10—10 of the top of the canister illustrated in FIG. 9.
Figure 8:
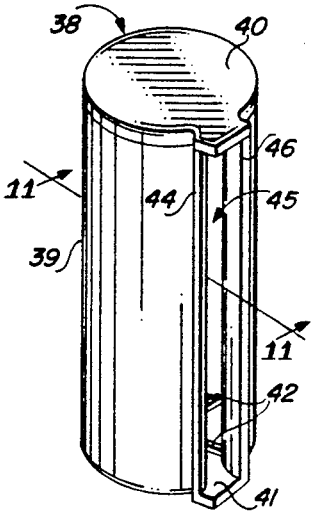
FIG. 8 is a perspective view of a preferred removable canister for housing the roll of transparent lenses utilized in the helmet with interchangeable lenses.
Figure 7:
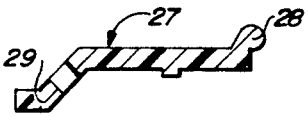
FIG. 7 is a sectional view taken along line 7—7 of the door element illustrated in FIG. 6.
Figure 11:
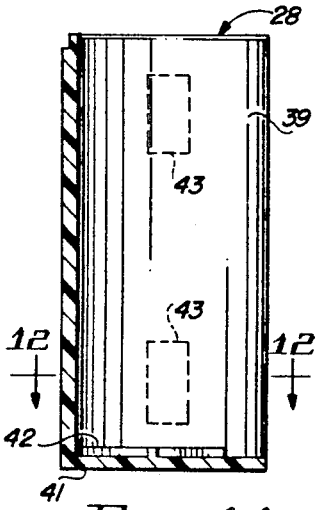
FIG. 11 is a sectional view taken along 11—11 of the canister illustrated in FIG. 8.
Figure 12:
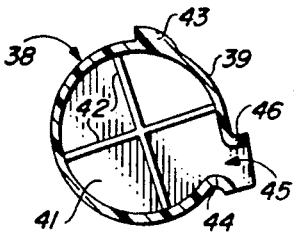
FIG. 12 is a sectional view taken along 12—12 of the canister illustrated in FIG. 11.
Figure 13:
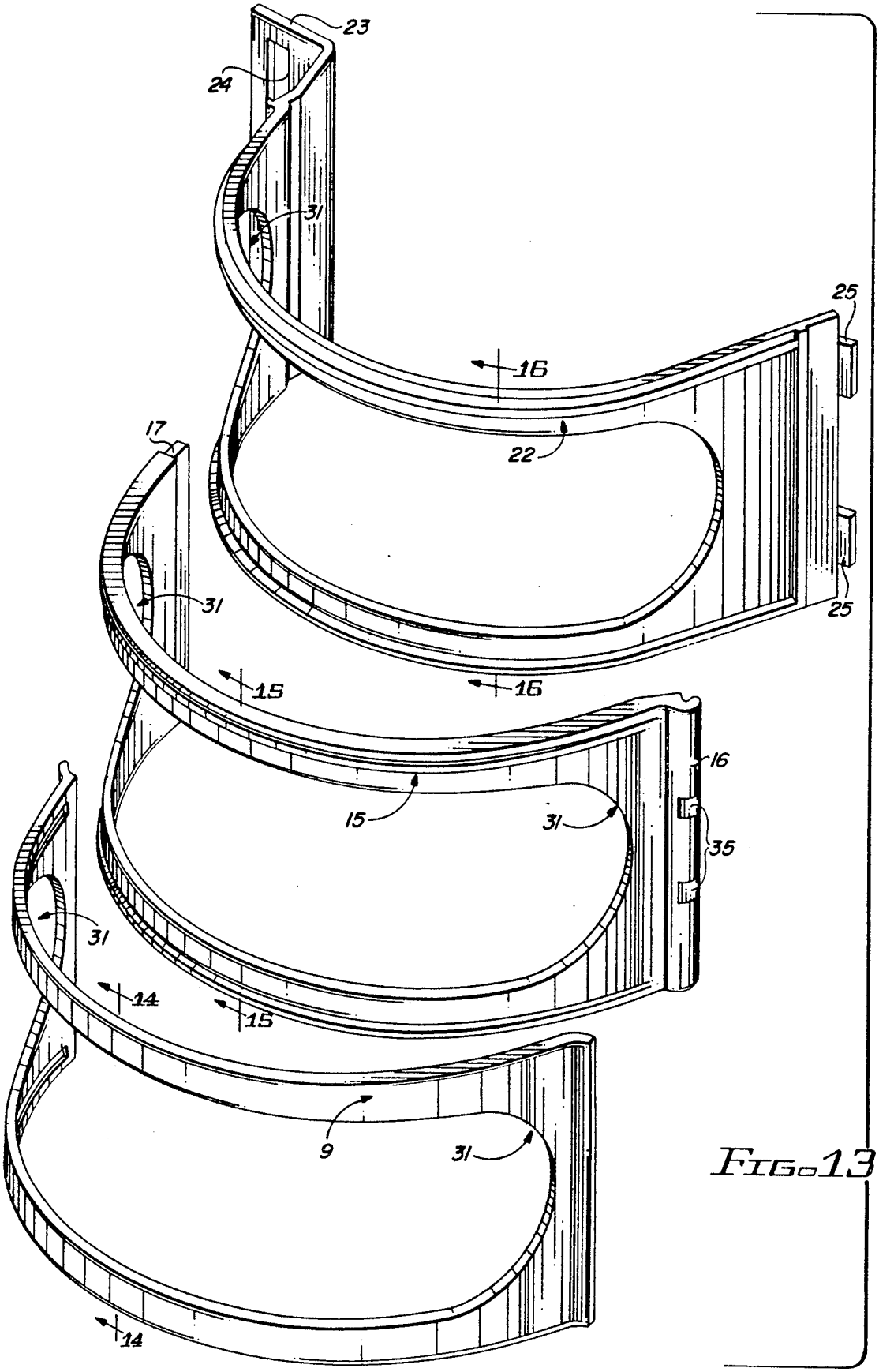
FIG. 13 is an exploded view of preferred outside track, middle track and inside track elements of the helmet illustrated in FIG. 1.
Figures 14, 15, 16, 17:
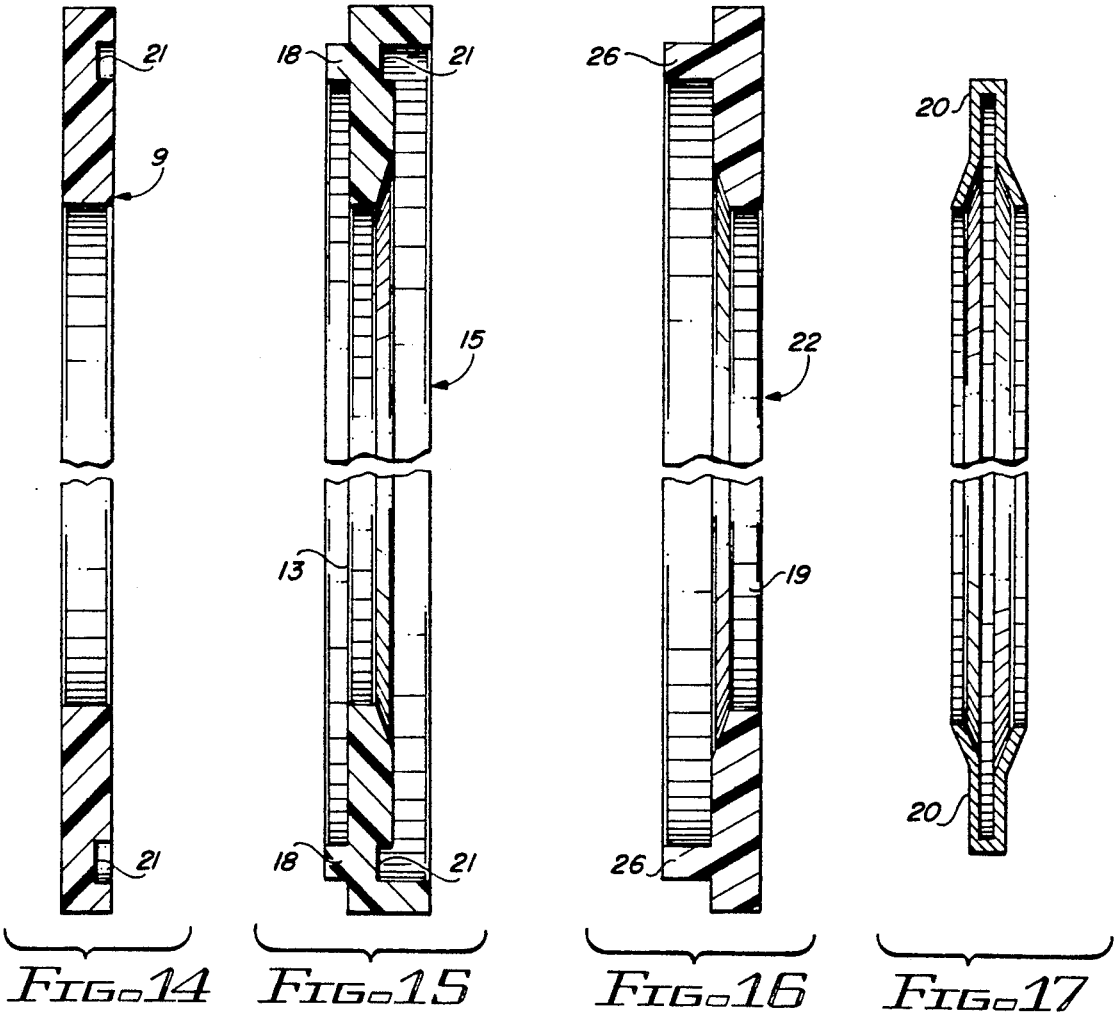
FIG. 14 is a linear sectional aspect of the outside track element of the helmet illustrated in FIG. 13.
FIG. 15 is a sectional linear aspect of the middle track of the helmet illustrated in FIG. 13.
FIG. 16 is a sectional linear aspect of the outside track of the helmet illustrated in FIG. 13.
FIG. 17 is a sectional linear aspect of a slot liner inserted between the middle track and outside track of the helmet illustrated in FIG. 1.

Referring initially to FIGS. 1–4 and 13 of the drawings, the helmet with interchangeable lenses of this invention is generally illustrated by reference numeral 1 and includes a molded dome 7, fitted with a cowl 2 at the bottom edge thereof. The cowl 2 is characterized by a top cowl segment 3, a front cowl segment 4 extending from the top cowl segment 3, a side cowl segment 5 projecting from the front cowl segment 4 and a bottom cowl segment 6 terminating the bottom edge of the cowl 2. The cowl 2 is fitted with an outside track 9, a middle track 15 and an inside track 22, oriented as illustrated in FIGS. 1, 3 and 13 and joined by fasteners 32, such as pop rivets, as illustrated in FIGS. 2 and 3, to define a lense window 8. The outside track 9 further includes a canister mount flange 10 at one end and a curved outside track lip 11 at the opposite end. The outside track 9 and the middle track 15 are joined as illustrated in FIG. 3 to define an outside lens slot 13 which receives a transparent lens 50, as further illustrated in FIG. 3 and hereinafter further described. The middle track 15 is further configured to define a middle track hinge 16 at one end and a middle track flange 17 at the opposite end, as further illustrated in FIGS. 1, 3 and 13. The middle track 15 and inside track 22 are configured to define an inside lens slot 19, adapted to receive a tinted lens 57, as further illustrated in FIGS. 2 and 3. A slot liner 20 is provided in the inside lens slot 19 for mounting the tinted lens 57 in the center of the inside lens slot 19, as hereinafter further described. The inside track 22 is further characterized by a canister latch flange 23 at one end, having a pair of spaced latch flange slots 24, for mounting a canister 38 in the helmet 1, as hereinafter further described. The opposite end of the inside track 22 terminates in a door retainer 25 which is designed to register with corresponding retainer apertures 29, provided in a door 27, having a hinge flange 28 for engaging the middle track hinge 16 of the middle track 15, as further illustrated in FIGS. 3 and 4. Accordingly, it will be appreciated from a consideration of FIGS. 3 and 4 that the door 27 is illustrated in closed configuration, with the retainer apertures 29, in the door 27, receiving corresponding door retainers 25 of the inside track 22. However, the door 27 can be opened in hinged relationship with the hinge flange 28 as a pivot point by grasping the door edge 27*a* of the door 27 and releasing the door 27 from the door retainer 25 to facilitate access to the inside lense slot 19 for insertion of an optional tinted lens 57 in the inside lens slot 19, as hereinafter further described.

As further illustrated in FIGS. 2 and 14–16 of the drawings, in a most preferred embodiment of the invention the outside track 9, middle track 15 and inside track 22 are joined by operation of the corresponding middle track tabs 18 and inside track tabs 26, which engage corresponding tab slots 21 on the outside track 9, middle track 15, respectively, as illustrated. This technique effects precise alignment of the outside track 9, middle track 15 and inside track 22 and the fasteners 32, such as pop rivets or the like, may be utilized to secure the outside track 9, middle track 15 and inside track 22 together at the middle track tabs 18 and inside track tabs 26, as illustrated in FIG. 2.

Referring to FIGS. 1, 3 and 8–12, in a most preferred embodiment of the invention the helmet 1 is fitted with a canister 38 having a cylindrical, hollow canister barrel 39, capped by a canister lid 40 at the top and fitted with a canister bottom 41 at the bottom thereof. The bottom ribs 42 may be provided in the canister bottom 41 for stiffening purposes and a pair of spaced canister retainers 43 extend longitudinally from the canister barrel 39, for engaging the corresponding latch flange slots 24 provided in the inside track 22. The canister barrel 39 is further fitted with a longitudinal canister lip 44 and a longitudinal feed slot flange 46, which are spaced to define a longitudinal canister feed slot 45 and complete the mounting apparatus for the canister 38. The curved canister lip 44 is designed to engage the canister mount flange 10 of the outside track 9 and cooperates with the spaced canister retainers 43 to removably secure the canister 38 in position between the outside track 9 and the inside track 22, as illustrated in FIG. 3.

Referring again to FIGS. 1–3 of the drawings, the transparent lens 50 is designed to slidably extend through the outside lens slot 13 from the lens roll 55 located in the canister barrel 39 of the canister 38, as more particularly illustrated in FIG. 3. Accordingly, when a single transparent lens 50 has been slidably manuevered through the outside lens slot 13 until the lens tab 51 projects from the outside track lip 11 of the outside track 9, the transparent lens 50 is in functional position for use. It then serves as the primary lens for the helmet 1 and can be utilized until the sandblasting, painting or other operation obscures it, after which the lens tab 51 may be grasped and the damaged functional transparent lens 50 displaced from the track window 31 to pull an adjacent, undamaged transparent lens 50 from the canister 38 into position over the track window 31. The two transparent lenses 50 are linearly connected at the perforations 52 and the lens apertures 53 which lie adjacent to the perforations 52 are designed to facilitate detachment of the damaged transparent lens 50 from the now functional new transparent lens 50. The lens apertures 53 are positioned to engage the corresponding lens stops 35, extending outwardly from the middle track hinge 16 of the middle track 15, to properly deploy the new transparent lens 50 in functional position in the track window 31 and facilitate convenient stripping of the damaged transparent lens 50 from the now functional new transparent lens 50, at the perforations 52.

Referring again to FIGS. 1–4, 6 and 7, when it is desired to insert the tinted lens 57 into the inside lens slot 19 of the helmet 1, the door 27 is opened by grasping the door edge 27*a* and pivoting the door 27 on the hinge flange 28 and corresponding middle track hinge 16. This action accesses the front edge of the inside lens slot 19 to facilitate sliding one edge of the tinted lens 57 into the inside lens slot 19 and continuing insertion of the tinted lens 57 into the inside lens slot 19 along the slot liner 20, until the tinted lens 57 completely traverses the track window 31. The door 27 can then be closed and the door retainers 25 re-engaged with the corresponding retainer apertures 29 to securely seat the tinted lens 57 in the inside lens slot 19, against the slot liner 20. Removal of the tinted lens 57 from the inside lens slot 19 can be effected by reversing this procedure. Accordingly, it will be appreciated by those skilled in the art that the tinted lens 57 may be inserted under circumstances where the helmet 1 is to be used in bright sunlight or in welding operations where it is desired to protect the eyes from the welding flash.

It will be appreciated by those skilled in the art that the helmet with interchangeable lenses of this invention offers a welcomed alternative to the current technology of placing multiple layers of acetate or other lenses over a base lens. This advantage is apparent under circumstances where the several stacked lenses are abraded or damaged such that multiple layers of the lenses are rendered unfit for the intended purpose. Since the transparent lenses 50 are safely stored in the canister 38 for sequentially and slidably positioning in the lens window 8, they are protected from the damage when the helmet 1 is in use. Furthermore, each new transparent lens 50 can be quickly, easily and slidably placed in position covering the lens window 8 as needed, by simply tearing the preceding transparent lens 50 from the leading edge of the corresponding new transparent lens 50 at the perforations 52, as heretofore described.

It will be further appreciated by those skilled in the art that the transparent lens 50 can be fabricated of substantially any transparent material, including acetate and polycarbonate materials, in non-exclusive particular, which materials are flexible and may be rolled into a spring-like configuration for fitting into the canister 38, according to the knowledge of those skilled in the art. Furthermore, the resulting lens roll 55 can be sealed inside the canister 38 such that the canister lid 40 cannot be easily opened, thereby requiring that a new canister 38 be inserted between the outside track 9 and inside track 22 when the lens roll 55 is depleted in the old canister 38. Moreover, under circumstances where the material of construction used to construct the helmet 1 has a limited life in the particular industrial application under consideration, the canister 38 can be fixedly attached to the helmet 1 and sealed to enclose a selected number of transparent lenses 50 which correspond to the average life of the helmet 1.

It will be still further appreciated that the canister 38 can be constructed with a canister barrel 39 of sufficient diameter to contain a selected number of rolled transparent lenses 50, depending upon the particular application desired and the helmet 1 can be constructed of any desired size and shape. It is only necessary that the distance between the perforations 52 in the lens roll 55 be sufficient to span the lens window 8.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A helmet with interchangeable lenses, comprising a top portion, cowl means extending from said top portion and shaped to substantially cover at least the eyes of a user; an opening provided in said cowl means; three substantially rigid and parallel tracks, said tracks spanning said opening in spaced relationship and defining an open window; fastener means joining said tracks to said cowl means in stacked relationship; a pair of outside lens slots and inside lens slots defined by said tracks in spaced relationship, said outside lens slots adapted for slidably receiving said interchangeable lenses in end-to-end relationship and positioning one of said interchangeable lenses in said window; flange means provided on one end of the inside one of said tracks; canister means provided at one end of said tracks for enclosing said interchangeable lenses in rolled configuration and selectively dispensing said interchangeable lenses in said window responsive to manual and sequential extension of said lenses along said outside lens slots; and retainer means extending from said canister means, said flange means adapted to removably receiving said retainer means and secure said canister means to said tracks.

2. The helmet of claim 1 further comprising perforations provided in said interchangeable lenses in spaced relationship to define a separate interchangeable lens between each set of said perforations.

3. The helmet of claim 1 wherein said fastener means further comprises rivet means extending through said cowl and said tracks for removably securing said tracks to said cowl.

4. The helmet of claim 1 further comprising:

(a) perforations provided in said interchangeable lenses in spaced relationship to define a separate interchangeable lens between each set of said perforations;

(b) a tinted lens carried by said inside lens slots in spaced relationship with respect to said interchangeable lenses; and wherein said fastener means further comprises;

rivet means extending through said cowl and said tracks for removably securing said tracks to said cowl.

5. The helmet of claim 1 wherein said top portion of said helmet is rounded and formed integrally with said cowl means.

6. The helmet of claim 1 comprising a tinted lens carried by said inside lens slots in spaced, substantially parallel relationship with respect to said one of said interchangeable lenses in said window.

7. The helmet of claim 6 further comprising perforations provided in said interchangeable lenses in spaced relationship to define a separate interchangeable lens between each set of said perforations.

8. The helmet of claim 6 further comprising slot liner means provided in said inside lens slot for cushioning said tinted lens in said inside lens slot.

9. The helmet of claim 6 further comprising door means hingedly carried by said tracks, whereby said tinted lens is selectively inserted in said inside lens slots and removed from said inside lens slots responsive to opening and closing said door means, respectively.

10. The helmet of claim 9 further comprising perforations provided in said interchangeable lenses in spaced relationship to define a separate interchangeable lens between each set of said perforations.

11. The helmet of claim 10 wherein said fastener means further comprises rivet means extending through said cowl means and said track means for removably securing said tracks to said cowl means.

12. The helmet of claim 9 wherein said tracks further comprise curved, substantially rigid tracks and further comprising perforations provided in said interchangeable lenses in spaced relationship to define a separate interchangeable lens between each set of said perforations and rivets joining said tracks to said cowl means at one end of said tracks.

13. A helmet with interchangeable lenses, comprising a closed top portion; a cowl extending integrally from said top portion; three substantial rigid, curved tracks mounted on said cowl in stacked relationship, said tracks further defining a lens window; a pair of spaced outside lens slots defined by the outside and middle ones of said tracks and a pair of spaced inside lens slots defined by the middle and inside ones of said tracks; a tinted lens carried by said inside lens slots and door means hingedly carried by said middle one of said tracks, whereby said tinted lens is selectively inserted in said inside lens slots and removed from said inside lens slots, respectively; a generally cylindrically-shaped canister carried by at least one of said tracks and a longitudinal slot provided in said canister is alignment with said outside lens slots; and a plurality of transparent lenses provided in said canister in rolled relationship, whereby said transparent lenses are individually extendible in sequence through said longitudinal slot in said canister and slidably in said outside lens slots to removably close said lens window.

14. The helmet of claim 13 further comprising perforations provided in said transparent lenses in spaced relationship to define a separate transparent lens between each set of said perforations.

15. The helmet of claim 13 further comprising a plurality of rivet means extending through said cowl and said tracks in spaced relationship, for removably securing said tracks to said cowl.

16. The helmet of claim 13 further comprising:
(a) perforations provided in said transparent lenses in spaced relationship to define a separate lens between each set of said perforations; and
(b) a plurality of rivet means extending through said cowl and said tracks in spaced relationship, for removably securing said tracks to said cowl.

17. The helmet of claim 13 further comprising flange means extending from the inside one of said tracks and retainer means extending from said canister, said flange means adapted to removably receiving said retainer means and secure said canister to said tracks.

18. The helmet of claim 17 further comprising:
(a) perforations provided in said transparent lenses in spaced relationship to define a separate lens between each set of said perforations;
(b) a plurality of rivets extending through said cowl and said tracks in spaced relationship, for removably securing said tracks to said cowl; and
(c) flange means extending from the inside one of said tracks and retainer means extending from said canister, said flange means adapted to removably receive said retainer means and secure said canister to said tracks.

19. A helmet with interchangeable and tinted lenses, comprising a rounded helmet; first, second and third curved tracks mounted on said helmet in stacked relationship, said tracks defining a common lens window; spaced outside lens slots defined by first track and said second track and spaced inside lens slots defined by said second track and said third track; a cylindrically-shaped canister carried by said first track and said third track and a longitudinal canister slot provided in said canister in alignment with said outside lens slot; a plurality of transparent lenses provided in said canister in rolled relationship, whereby said transparent lenses are linearly extended in sequence through said longitudinal canister slot and slidably in said outside lens slots to close said lens window; a tinted lens carried by said inside lens slots in spaced relationship with respect to said interchangeable lenses; and door means hingedly carried by said middle track, whereby said tinted lens is selectively inserted in said inside lens slots and removed from said inside lens slots responsive to opening and closing said door means, respectively.

20. The helmet of claim 19 further comprising perforations provided in said transparent lenses in spaced relationship to define a separate transparent lens between each set of said perforations.

21. The helmet of claim 19 further comprising a plurality of rivets extending through said helmet and said tracks in spaced relationship, for removably securing said tracks to said helmet.

22. The helmet of claim 19 further comprising:
(a) perforations provided in said transparent lenses in spaced relationship to define a separate transparent lens between each set of said perforations; and
(b) a plurality of rivets extending through said helmet and said tracks in spaced relationship, for removably securing said tracks to said helmet.

23. The helmet of claim 19 further comprising flange means provided at one end of said third track and retainer means extending from said canister, said flange means adapted to removably receive said retainer means and secure said canister to said third track and said first track.

24. The helmet of claim 19 further comprising:
(a) perforations provided in said transparent lenses in spaced relationship to define a separate transparent lens between each set of said perforations;
(b) a plurality of rivets extending through said helmet and said tracks in spaced relationship, for removably securing said tracks to said helmet; and
(c) flange provided at one end of said third track and retainer means extending from said canister, said flange means adapted to removably receive said retainer means and secure said canister to said third track and said first track.

* * * * *